US005228163A

United States Patent [19]

Arzaghi

[11] Patent Number: 5,228,163

[45] Date of Patent: Jul. 20, 1993

[54] HIGH-HEEL SHOE REPAIR MACHINE

[76] Inventor: Mehdi D. Arzaghi, 60 Pine Avenue West, Montreal, Quebec, Canada, H2W 1RZ

[21] Appl. No.: 738,508

[22] Filed: Aug. 2, 1991

Related U.S. Application Data

[63] Continuation-in-part of Ser. No. 452,237, Dec. 18, 1989, abandoned.

[51] Int. Cl.[5] ..... A43D 45/00

[52] U.S. Cl. ..... 12/50.5; 12/125

[58] Field of Search ..... 12/50.5, 42 R, 125, 12/123

[56] References Cited

U.S. PATENT DOCUMENTS

| | | | |
|---|---|---|---|
| 2,269,514 | 1/1942 | Brandt | 12/125 |
| 2,306,788 | 12/1942 | MacDonald | 12/125 |
| 2,618,795 | 11/1952 | Leahy et al. | 12/125 |
| 2,934,772 | 5/1960 | Bagshaw et al. | 12/50 |
| 2,992,445 | 7/1961 | Nelson | 12/50.5 |
| 3,069,707 | 12/1962 | Harper | 12/50.5 |
| 3,083,385 | 4/1963 | Chafin et al. | 12/50.5 |
| 3,171,147 | 3/1965 | Friday | 12/50.5 |
| 4,480,778 | 11/1984 | Giebel | 12/42 R |

FOREIGN PATENT DOCUMENTS

| | | | |
|---|---|---|---|
| 904534 | 8/1962 | United Kingdom | 12/50.5 |

*Primary Examiner*—Steven N. Meyers
*Attorney, Agent, or Firm*—Fishman, Dionne & Cantor

[57] ABSTRACT

A circular member supports the shoe from which the pin is to be removed such that the high-heel of the shoe extends downwardly along the vertical axis. The circular member is pivotable about the horizontal axis. A grasper, which includes a gap defined by one movable jaw and one fixed jaw, and a rotary handle for closing and opening the gap, grasps the pin. The grasper is moved up and down by a piston and cylinder arrangement. Thus, when the grasper grasps the pin, and the piston and cylinder arrangement moves the grasper in the direction away from the shoe, the pin is removed from the shoe.

8 Claims, 14 Drawing Sheets

HIGH-HEEL SHOE REPAIR MACHINE

CROSS-REFERENCE TO RELATED APPLICATION

This application is a Continuation-In-Part application of U.S. Ser. No. 452,237, filed Dec. 18, 1989, now abandoned.

BACKGROUND OF INVENTION

1. Field of the Invention

The invention relates to a portable apparatus for removing the pin from the high-heel of a lady's shoe. More specifically, the invention relates to such an apparatus having a pivotable shoe support means and/or being driven by hydraulic or pneumatic means or ratchet The apparatus also includes means for applying new top lift and pin.

2. Description of Prior Art

Apparatus of this general kind is mainly for the removal of the top lift and pin of high-heel shoes after the top lift has been worn-off and replacement of a new top lift and pin is necessary. Because the pins are firmly inserted into the heels to prevent them from falling off, they generally cannot be pulled out by hand or ordinary tools. Accordingly, it is necessary to have a proper apparatus for this purpose. With all due respect and appreciation for the variety of apparatus that have already been designed for this purpose, of which I am aware by either having studied them or studied patents describing them, I have been working with them and observing them. I have found major flaws in their function, some of which are discussed below, arising mainly from complicated mechanics or functional insufficiency in comparison with my novel apparatus.

The shoe repair person uses a multi-functional machine which, in addition to removing the pin from the heel of the lady's shoe performs a few other functions. Accordingly, this is a large and expensive machine which is immovable and must be firmly attached to the floor. Such a machine is illustrated in U.S. Pat. No. 3,083,385, Chafin et al, Apr. 2, 1963.

Single purpose machines, for the purpose of removing the pins from the heels of ladies shoes, are also known in the art as illustrated in, for example, U.S. Pat. No. 2,992,445, Nelson, Jul. 18, 1961, U.S. Pat. No. 3,069,707, Harper, Dec. 25, 1962 and U.S. Pat. No. 3,171,147, Friday, Mar. 2, 1965. In all of these Patents, the drive is mechanical, so that it requires a good deal of strength for the operation thereof. In addition, the machines are stationary and cannot easily be moved about. They are therefore not very easy for operation by ladies.

In addition, the shoe support means in all of the Patents are in a fixed position relative to the horizontal or vertical axis. Thus, sleeve 24 of the '445 Patent remains fixed regardless of the size or orientation of the heel of the shoe inserted therein. Heel opening 24 of the '707 Patent also remains fixed as does U-shaped rod 36 of the '147 Patent. As will be illustrated below, depending on the length of the heel, the heel will be oriented at different angles to the vertical when the support means is fixed in a horizontal, or any other fixed angle, position. Thus, the vertical force applied will be applied only partially to the removal of the pin. The horizontal component will not be applied to the removal of the pin.

Thus, a certain amount of force is being wasted with the prior art machines.

More seriously, as there is an applied horizontal force, it is possible that this horizontal force will break the heel or pin.

U.S. Pat. No. 2,934,772, Bagshaw et al, May 3, 1960, illustrates a machine for mounting the pin and rubber heel on the high-heel of a lady's shoe. It does not teach any means for removing the pin from the high-heel.

SUMMARY OF INVENTION

It is therefore an object of the invention to provide a portable apparatus for removing the pin from the heel of a lady's shoe.

It is a further object of the invention to provide such an apparatus wherein the shoe support means is pivotable about a horizontal axis.

It is a further object of the invention to provide such an apparatus wherein the pin is removed from the heel with a smooth motion.

To provide such a smooth motion, the apparatus may include a pneumatic or hydraulic drive or a ratchet drive.

It is a still further object of the invention to provide such an apparatus which includes anvil means for the convenience of the user.

It is an even more specific object of the invention to provide a trouble-free apparatus which also can be used by a non-professional and which is inexpensive enough so that it can be owned by individuals in their homes, to thereby save time and money and provide greater independence for the individual.

In accordance with an embodiment of the invention there is provided a portable apparatus for removing the pin from the heel of a lady's shoe, comprising:

support means for supporting said shoe such that said heel extends along a vertical axis;

grasping means for grasping said pin;

a piston and cylinder arrangement for moving said grasping means along said vertical axis, the free end of said piston being connected to said grasping means;

whereby, when said grasping means grasps said pin, and said shoe is supported in said support means, and said arrangement moves said grasping means in a direction away from said shoe along said vertical axis, said pin is removed from said shoe.

In accordance with a further embodiment of the invention there is provided a portable apparatus for removing the pin from the heel of a lady's shoe, comprising:

freely pivotable support means for supporting axis, said support means being pivotable about the horizontal axis;

grasping means for grasping said pin;

an arrangement for moving said grasping means along said vertical axis in a smooth motion;

whereby, when said grasping means grasps said pin, and said shoe is supported in said support means, and said arrangement moves said grasping means in a direction away from said shoe along said vertical axis, said pin is removed from said shoe with a smooth motion.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
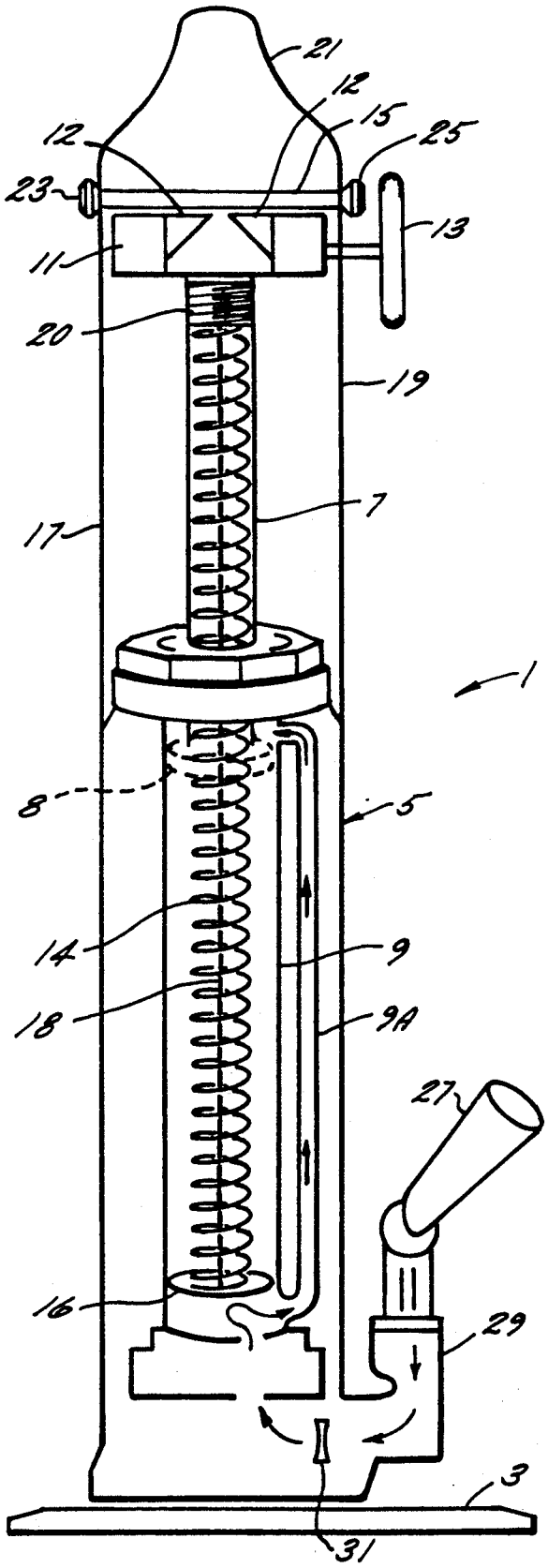
FIG. 1 is an illustration of one embodiment of the invention using a piston and cylinder arrangement with the piston in its uppermost position and the cylinder being shown in section.
Figure 2:
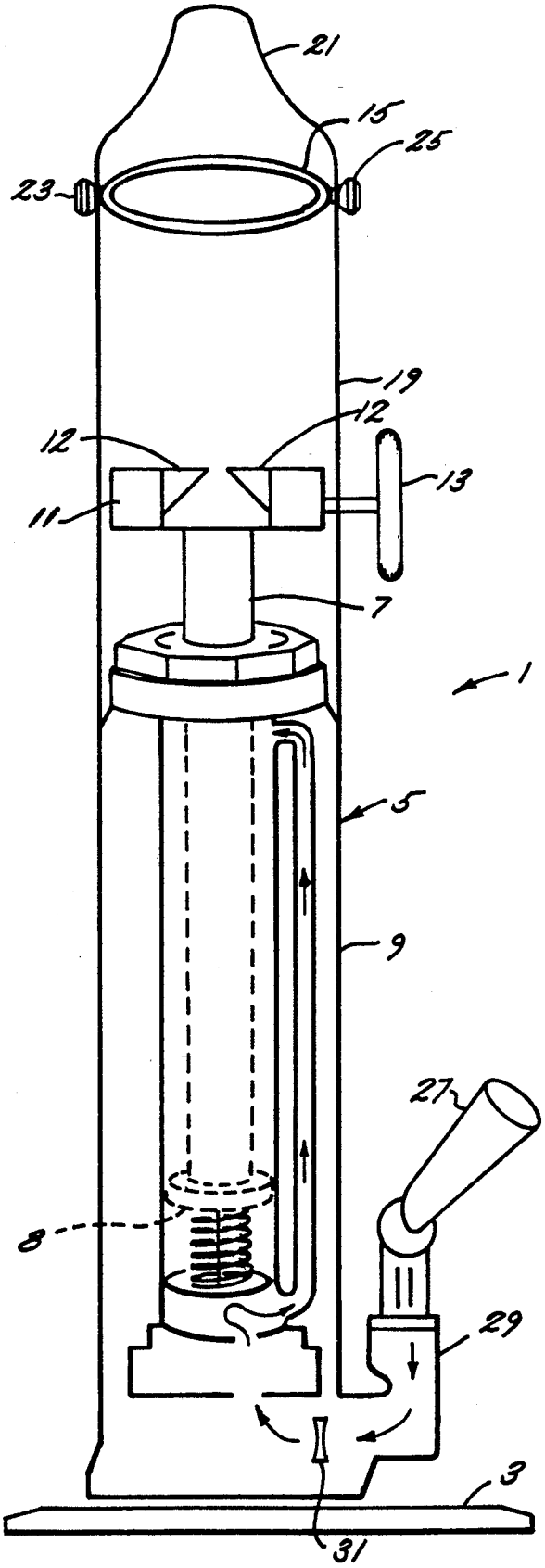
FIG. 2 illustrates the same embodiment as FIG. 1 with the piston in a lowered position.

Referring to FIGS. 1 and 2, the apparatus, illustrated generally at 1, is mountable on a base 3 and consists of a piston and cylinder arrangement, illustrated generally at 5. The piston and cylinder arrangement 5 comprises a piston 7 and a cylinder 9. The piston includes a piston head 8. Grasping means 11 is screwed onto thread 20 at the free end of piston 7. Grasping means 11 consists of two jaws 12 one of which is movable towards and away from the other by a rotary handle means 13.

Spring 14 rests on the plug 16 and passes through the piston 7. Rod 18 extends centrally of the spring and prevents the spring from bending during operation.

Figure 5:
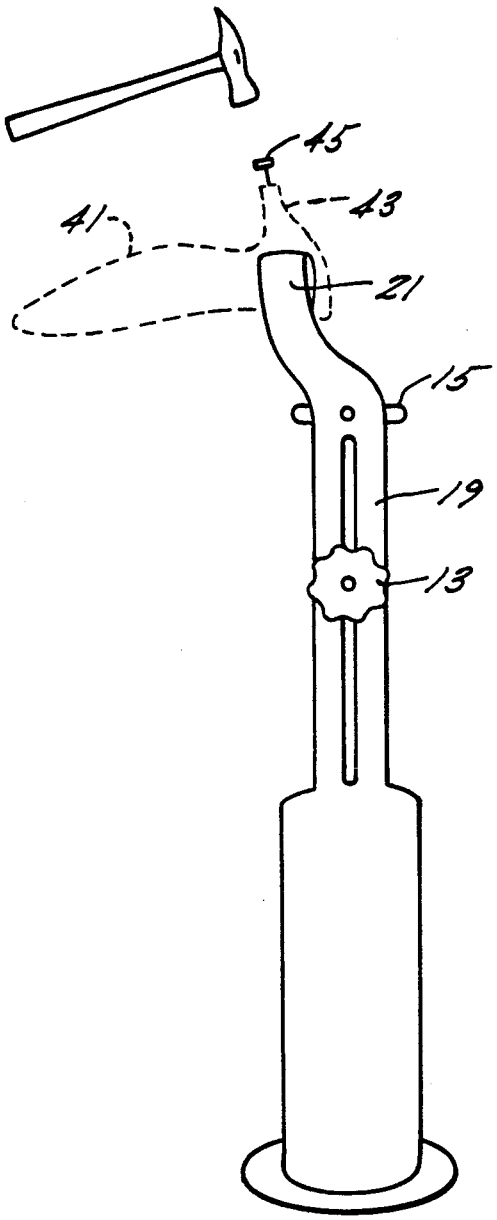
FIG. 5 illustrates how the anvil is used with a shoe in the FIG. 1 embodiment.
Figure 5A:
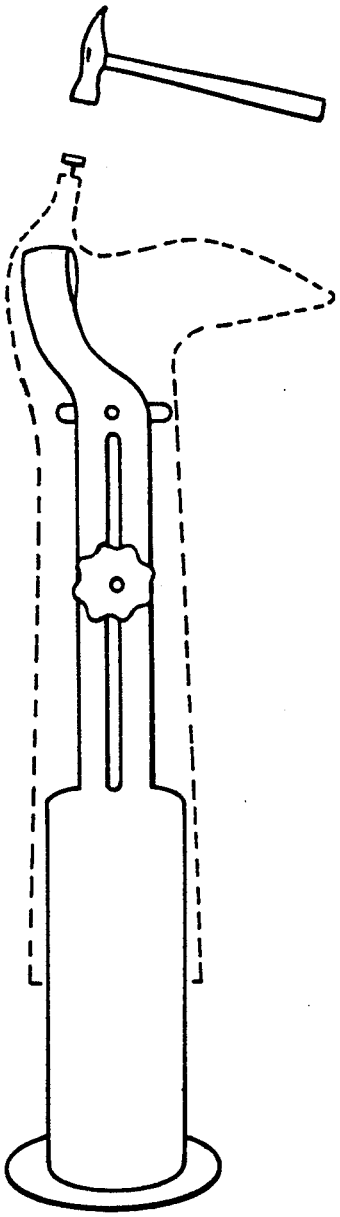
FIG. 5A illustrates how the anvil is used with a boot in the FIG. 1 embodiment.

Extending upwardly from the top of the cylinder are identical side walls 17 and 19 (see also FIG. 5). The side walls support a shoe support means 15 which, in one embodiment as seen in FIG. 2, comprises a circular member. The side walls 17 and 19 extend upwardly above circular member 15 to form an anvil 21, As seen in FIG. 5, the anvil 21 curves away from the longitudinal axis of the piston and cylinder arrangement so as to not interfere with the placement of a shoe in the circular member 15, especially when using the apparatus on high boots.

Returning to FIG. 1, the circular member 15 is connected to side walls 17 and 19 to be pivotable about a horizontal axis by screw means or pins 23 and 25.

A handle 27 is provided to drive an air or oil fluid pump 29 to force air or oil into the cylinder 9 above the piston head 8. Plug 16 prevents the air or oil from entering the cylinder 9 at the bottom end thereof and insures that the air or oil enters pipe 9A to enter cylinder 9 at the top end thereof. Thus, the air or oil forced into the cylinder will force the piston head 8, and thereby the piston 7, in a downward direction against the force of spring 14.

Release valve 31 (shown schematically) is provided to permit the escape of air or oil pumped into the cylinder when the release valve is opened.

Figure 4:
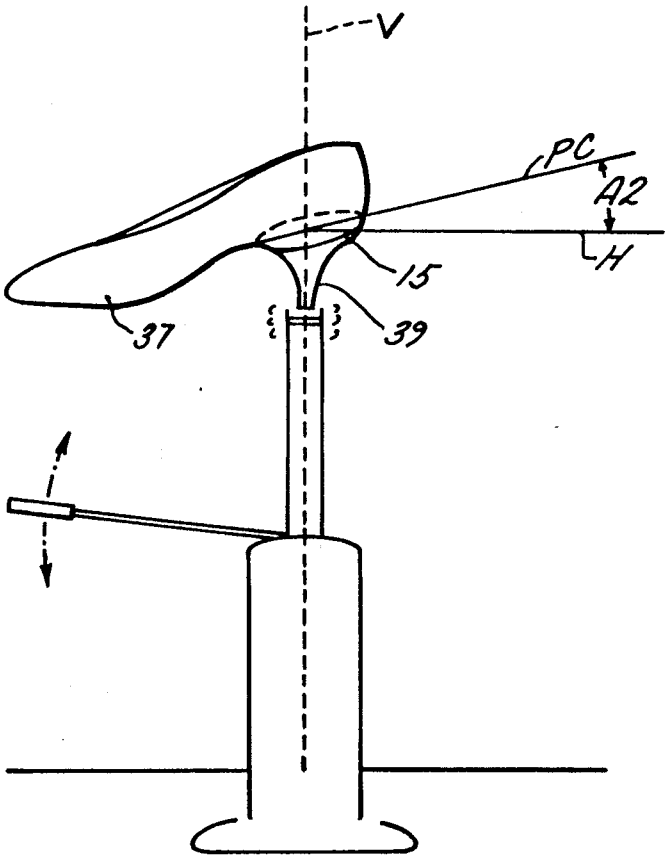
FIGS. 3 and 4 illustrate the operation of the pivotable support means.
Figure 3:
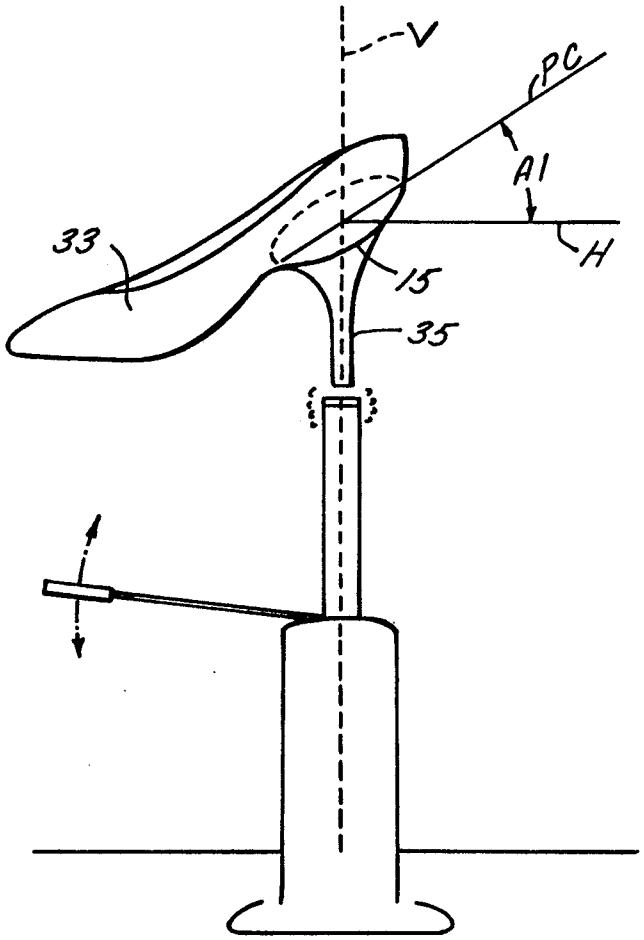

Turning now to FIGS. 3 and 4, when a shoe 33, having a relatively long heel 35, is mounted in the horizontal H and the plane PC of the circular member 15 is relatively steep. In contradistinction, as seen in FIG. 4, when a shoe 37 having a relatively low heel 39 is inserted in the circular member, then the angle A2 between the horizontal H and the plane PC of the circular member 15 is relatively shallow. This illustrates that fixing the support member at an angle to the horizontal or any fixed angle would not be a sufficient solution to the problem of the prior art in that no single angle could accommodate both the long high-heel and the short high-heel illustrated in FIGS. 4 and 5.

It is also apparent that if the support member were fixed in line with the horizontal, or any other fixed angle, then both heels 35 and 39 would not be in line with the vertical axis V so that the vertical force which is applied would be broken into two components, a vertical and a horizontal, and only the vertical force would be utilized in pulling the pin out of the heel. Thus, not all of the force is utilized for the required purpose. Also, as above-mentioned, the horizontal force could act to break the heel or pin.

In contradistinction, as seen in FIGS. 3 and 4, both heels 35 and 39 line up with the vertical axis which also constitutes the longitudinal axis of the piston and cylinder arrangement. Accordingly, all of the force applied is applied to remove the pin from the heels.

Referring to FIG. 5, it is seen how a shoe 41, having a heel 43, is mounted on the anvil 21 for the purpose of driving a pin 45 into the heel 43.

In operation, a shoe is mounted so that the heel extends through the circular member 15 as illustrated in FIGS. 3 and 4. One jaw 12 of the grasping means 11 is moved towards the other to grasp the pin, and the handle is then moved up and down to pump air or oil into the cylinder above the piston head 8. Accordingly, the piston head 8, and therefore the piston , 7, are moved in a downwardly direction, while the shoe remains in a pivotable position held by the circular member 15. Accordingly, the pin is pulled out of the heel.

Release valve 31 is then opened to permit the escape of the air or oil pumped into the cylinder. At that time, the spring 14 will force piston 7 automatically upwardly to its original position as illustrated in FIG. 1, and the apparatus is ready to remove the next pin.

The design, being a simple up-and-down arrangement, is both simple and attractive and does not require a great deal of space. In addition, because all of the action takes place along the vertical axis, which coincides with the longitudinal axis of the piston and cylinder arrangement, the arrangement is stable even during operation. It is only necessary to provide a base 3 which is of a somewhat larger diameter than the diameter of the cylinder, so that the apparatus is portable.

The use of a pneumatic or hydraulic piston and cylinder arrangement permits the apparatus to be operated with a minimum expenditure of energy so that it can be handled easily by even the most delicate of females. In addition, the entire apparatus will be very light-weight and the bridge of the anvil could be used as a handle for moving the apparatus. In addition, having an anvil for use in inserting the pin makes the apparatus even more convenient.

Because of the thickness of circular member 15, in the rare case of thick and very short heels, it is necessary that the top surface of grasping means 11 be narrow enough to pass through circular member 15 until it is approximately level to the top surface of circular member 15 so that it can grasp the short high-heel to pull the pin out.

Because the machine is in the shape of a cylinder, its appearance is more attractive especially when compared to a mechanical appartus. This has an advantage because generally speaking ladies are not very mechanical.

Because the entire mechanism is simple, there is substantially no need for spare parts or repair.

To prevent the body of the heels or the shoe from being scratched or peeled-off while the pin is being removed, the circular member 15 is covered with a thin soft plastic hose-like covering.

In addition, because the apparatus is operated on a step-by-step basis (pulling approximately three-sixteenths of an inch for each pump of the piston and cylinder arrangement), the sudden removal of the pin is avoided. This also prevents breakage of the heels or pins making the apparatus safer and easier to work with.

Figure 6:
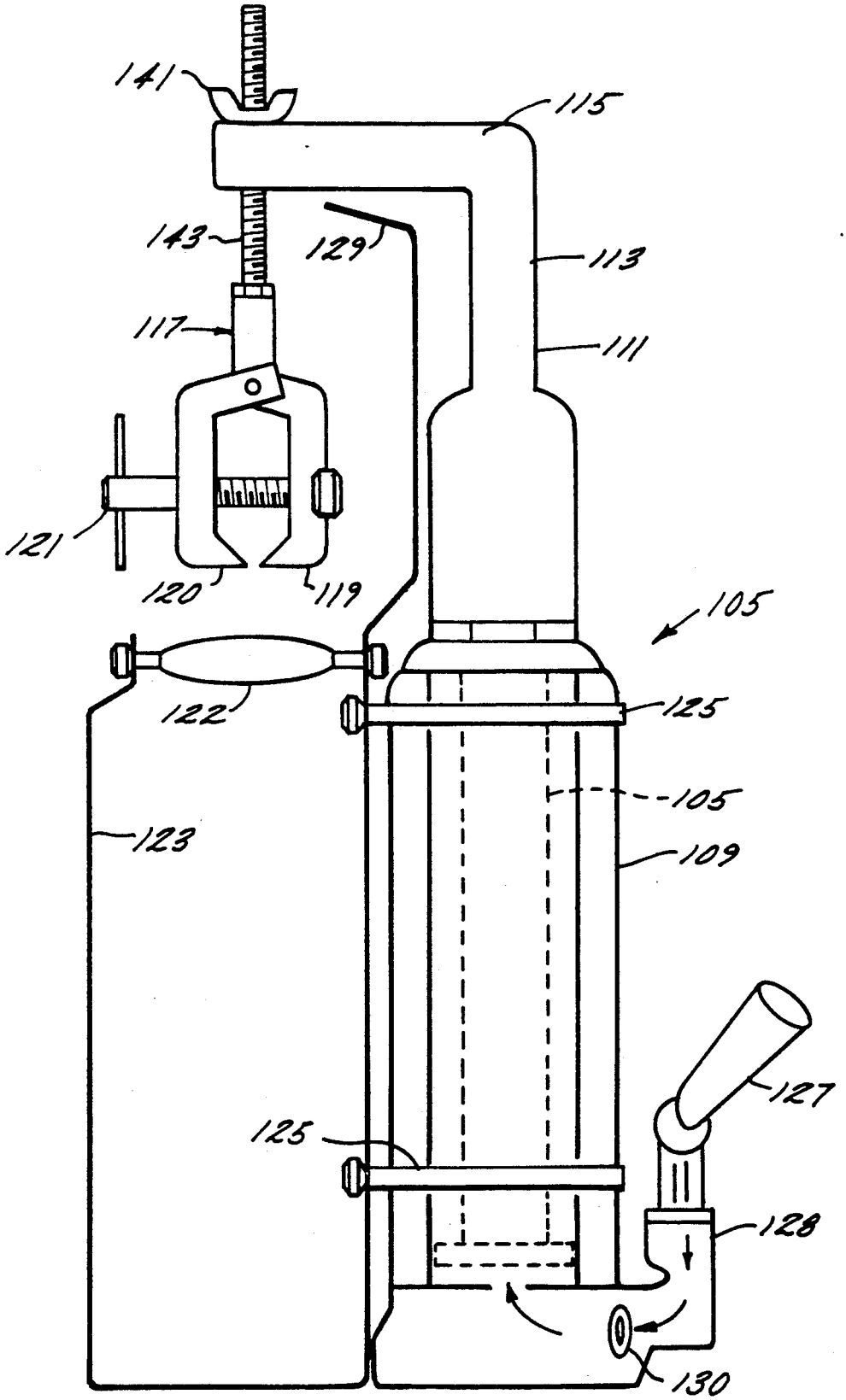
FIG. 6 illustrates a further embodiment of the invention.

Turning now to FIG. 6, which illustrates a second embodiment of the invention, the piston and cylinder arrangement, illustrated generally at 105 includes the piston 107 and the cylinder 109. Attached to the free end of the piston 107 is at L-shaped member 111 having a vertical leg 113 and a horizontal leg 115. Extending from the free end of the horizontal leg is a grasping means 117 which includes jaws 119 and 120. Jaw 120 is movable towards and away from jaw 119 by handle 121. The shoe support means comprises a circular member 122 which is pivotally mounted on supporting frame 123. The supporting frame is fixed to the cylinder by straps 125, and the free end of frame 123 is formed as an anvil 129.

Handle 127 is provided to drive an air or oil pump 128 as in the above embodiments. Release valve 130 is located at the bottom of pump 128.

Figure 6A:
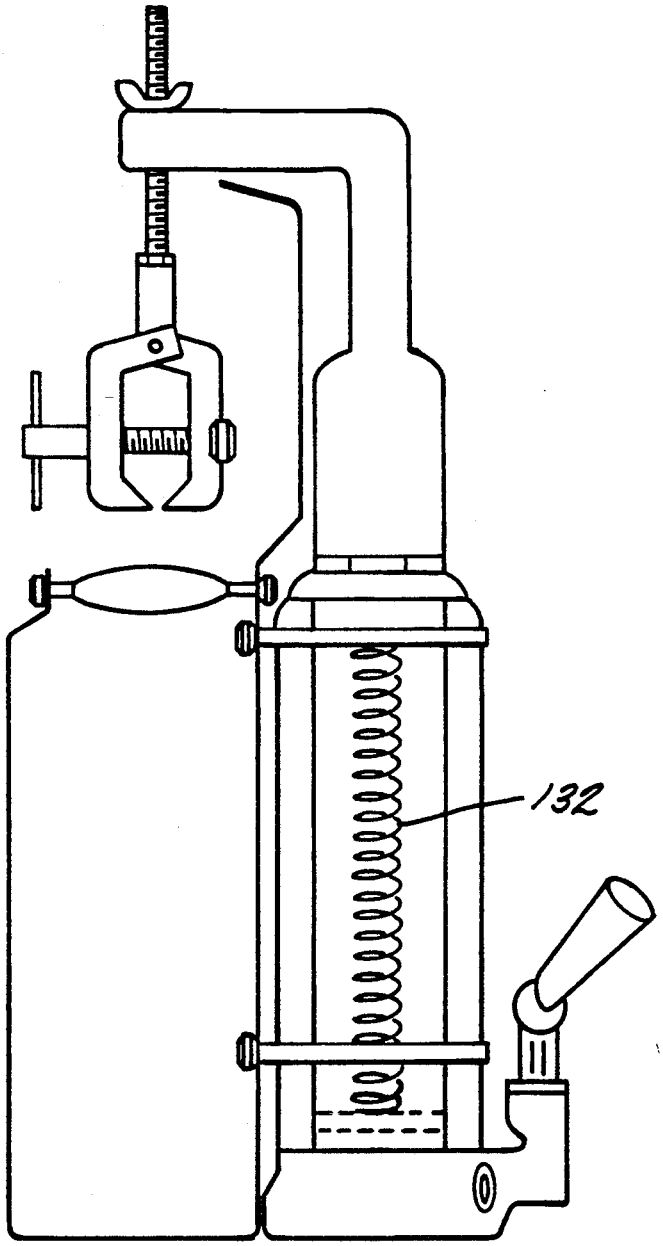
FIG. 6A illustrates a piston returning spring in the embodiment of FIG. 6.

As seen in FIG. 6A, spring 132, wound around the piston, can be provided to return the piston to its initial position.

In operation, the shoe is located below the circular member 122 with the heel pointing upwards through circular member 122 and towards the grasping means 117. The shoe is manually held in position until the jaws 119 and 120 are fastened on the pin of the heel of the shoe. The shoe can then be released and the handle 127 is operated to lift the piston 107 upwardly whereupon the pin will be withdrawn from the heel of the shoe.

Figure 7:
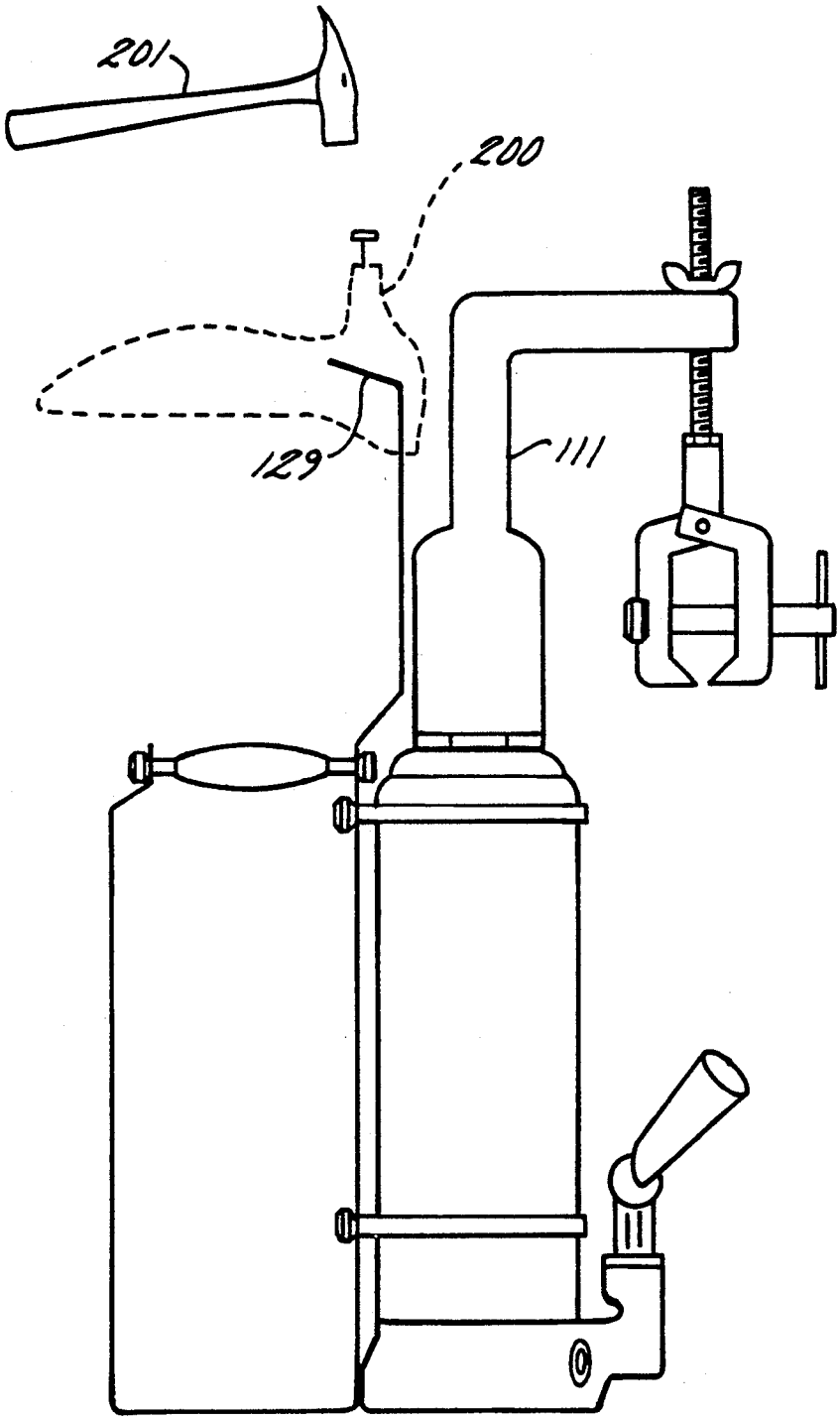
FIG. 7 illustrates how the anvil is used in the FIG. 6 embodiment.

To replace the worn-out top fit, the L-shaped member 111 is rotated as shown in FIG. 7. Shoe 200 is then mounted on the anvil 129 and the worn-out top lift is replaced with a hammer 201 as is well known in the art.

It is noted that the grasping means 117 in FIG. 6 is adjustable in height by simply rotating wing nut 141 on screw 143. Thus, the grasping means can be lowered so that it is abutting with the circular member 122 so that the pin of a very low heel could still be grasped by the grasping means. On the other hand, if the heel of the shoe is a very high-heel, then the height of the grasping means 117 will be adjusted upwardly so that the piston will not have to be pumped through too high a distance in order to remove the pin.

Figure 8:
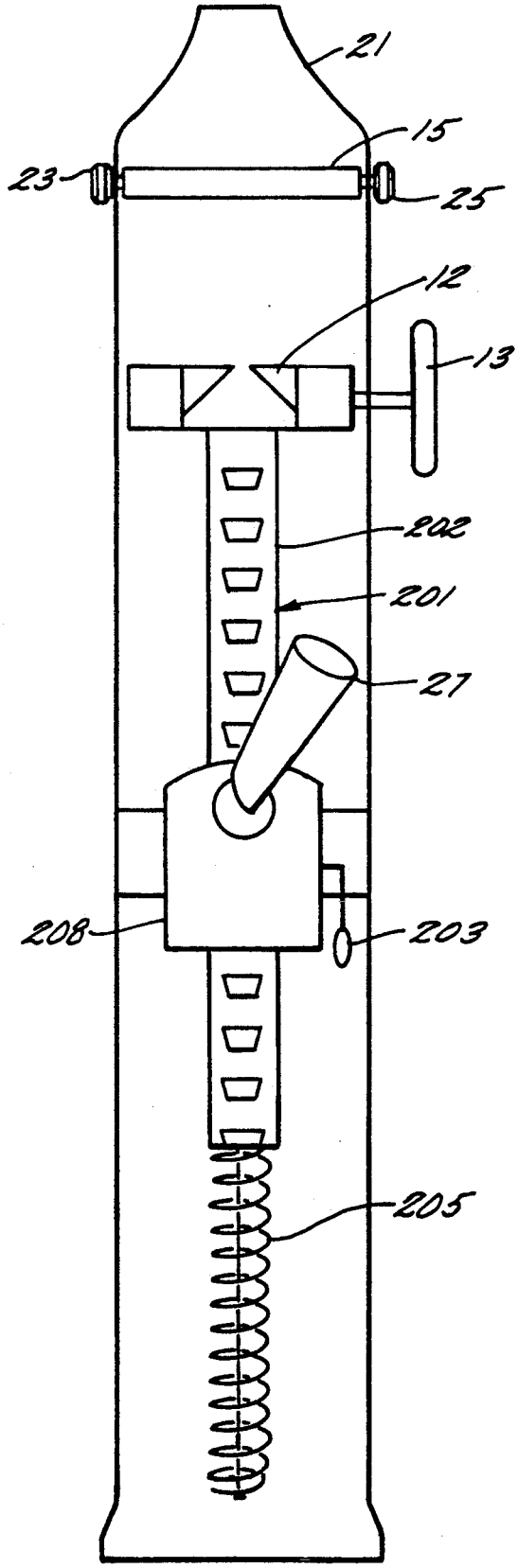
FIG. 8 illustrates an embodiment of the invention using a ratchet drive.
Figure 9A:
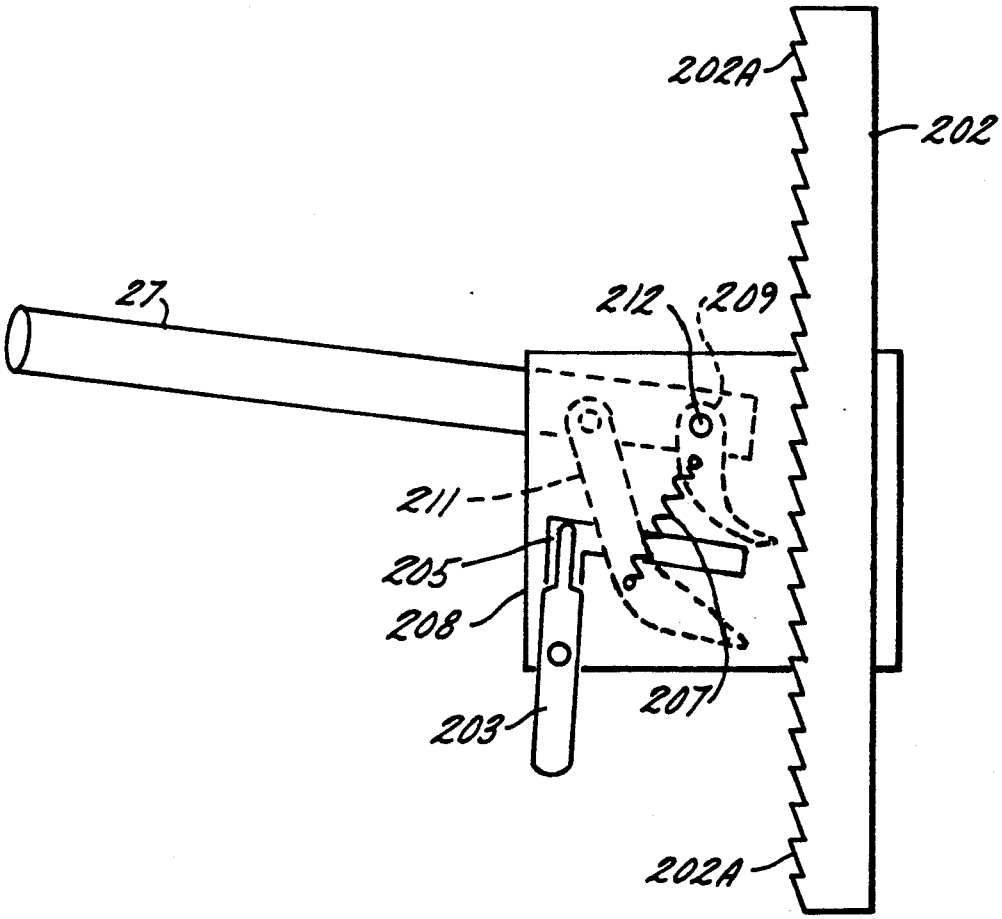
FIG. 9A illustrates the ratchet of the ratchet drive in FIG. 8 in a non-operative condition.
Figure 9B:
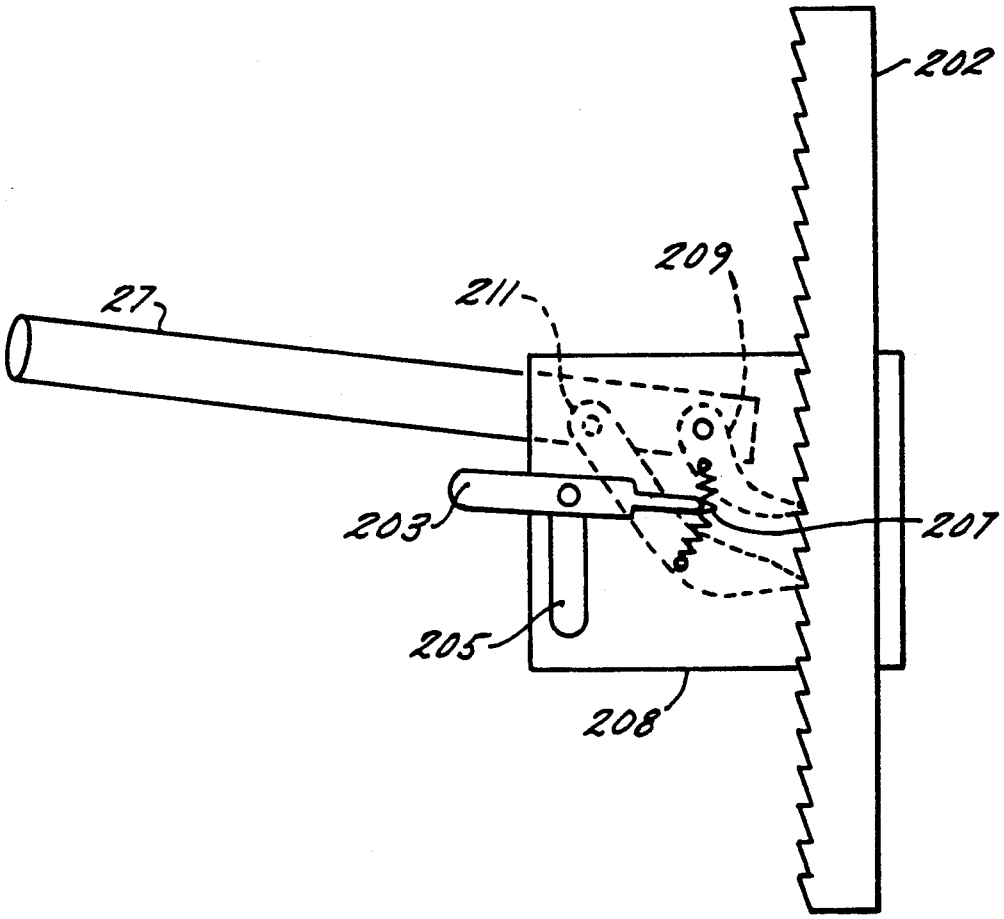
FIG. 9B illustrates the ratchet of the ratchet drive in FIG. 8 in an operative condition.

The embodiments illustrated in FIG. 8 is identical, in all respects, to FIG. 1 except that the piston and cylinder arrangement 5 of FIG. 1 is replaced by a ratchet arrangement 201 in FIG. 8. The ratchet arrangement 201, as illustrated in FIGS. 8, 9A and 9B, consists of a box 208, ratchet board 202 having a plurality of teeth 202A, a release mechanism 203, a guide path 205 for guiding the release mechanism 203, and a spring 207, which is engaged by the release mechanism 203 as illustrated in FIG. 9B when release mechanism 203 is moved along the guide 205.

The ratchet arrangement also includes a finger 209, which is pivotally attached to box 208 and handle 27 by pin 212 which passes through box 208, and a finger 211, which is fixedly attached to handle 27. By up and down movement of the handle 27, the ratchet board 202 will be moved downwardly, tooth by tooth, by the action of finger 211, against the force of the spring 205 pulling grasping means 11, which is fixedly attached to the top of ratchet board 202, with it. Finger 209 prevents the ratchet from moving upwardly during operation.

Figure 10:
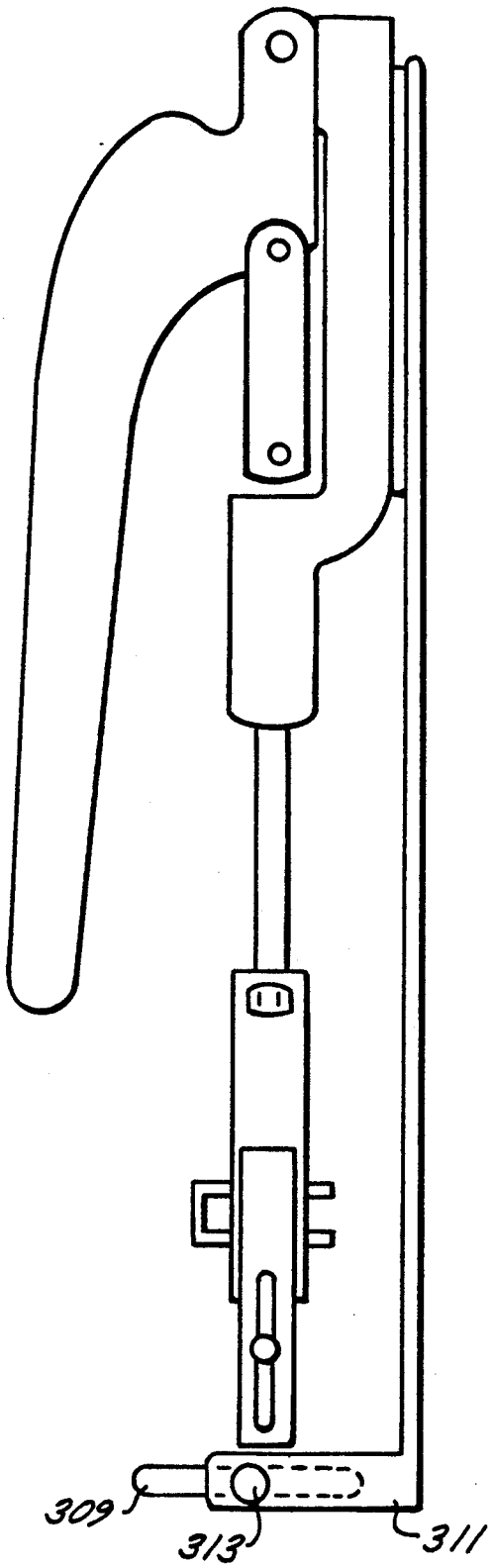
FIG. 10 illustrates a modification to the apparatus shown in FIGS. 1 and 2 of U.S. Pat. No. 2,992,445, Nelson.

FIG. 10 shows a modification to the apparatus illustrated in FIGS. 1 and 2 of U.S. Pat. No. 2,992,445, Nelson. Specifically, the fixed U-shaped shoe support 24 of Nelson is replaced with a pivotable support means 309 in FIG. 10 (See also FIG. 13).

Figure 11:
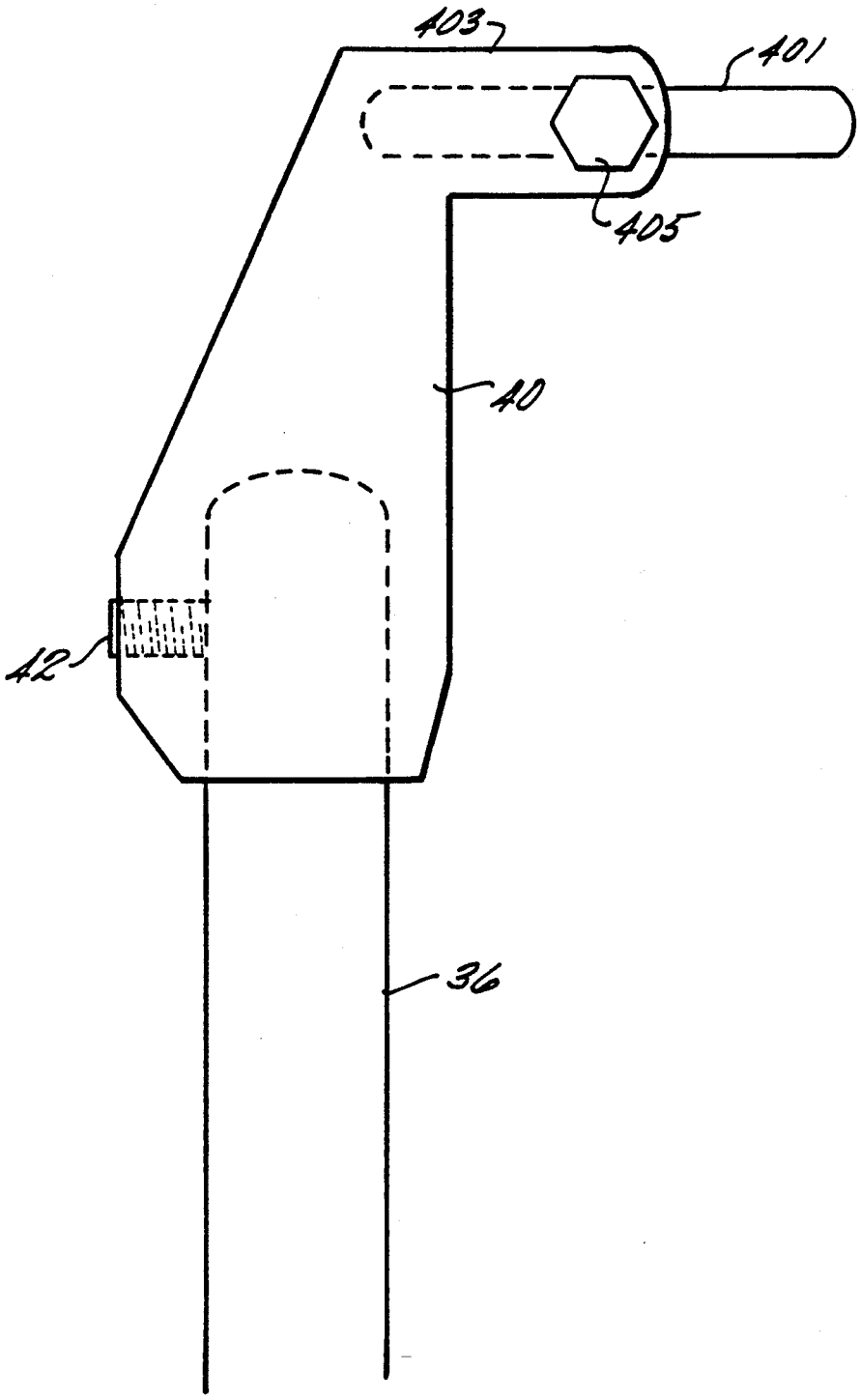
FIG. 11 illustrates an attachment for use in a machine as illustrated in, for example, above-mentioned U.S. Pat. No. 3,083,385.

FIG. 11 illustrates a replacement part for the body member 40 shown in FIG. 1 of U.S. Pat. No. 3,083,385. The replacement part is illustrated as 40' in FIG. 11 and is mountable on the rod 36 also illustrated in the '385 patent at FIG. 1. A screw 42 fixes the part 40' to the rod 36.

Figure 14:
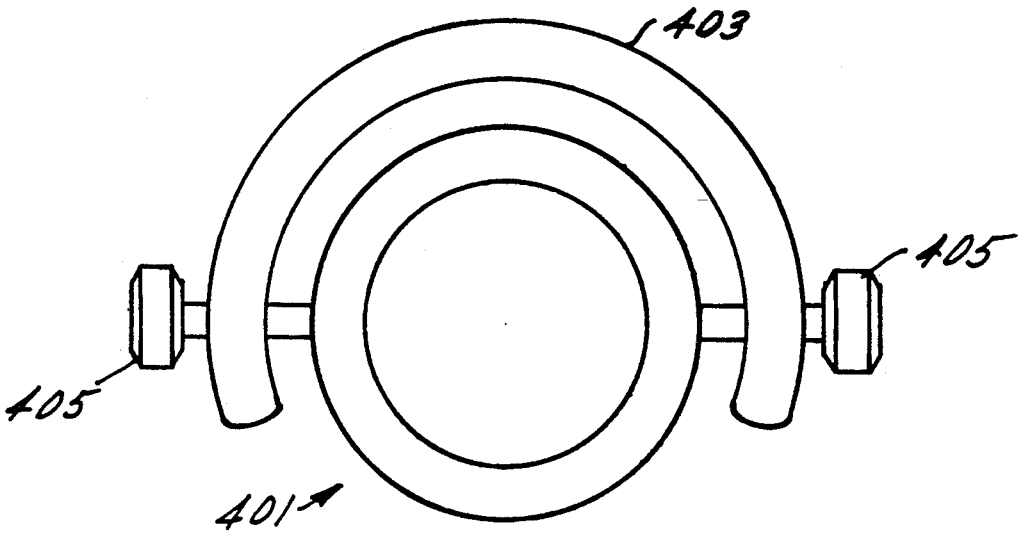
FIG. 14 illustrates an embodiment of a support means which can be used in the embodiment illustrated in FIG. 11.

The part 40' of FIG. 11 includes a pivotable support means 401. As seen in FIGS. 11 and 14, the holder 403 mounts the pivotable support means 401 by means of pins or screws 405. Accordingly, it is possible to improve on the prior art device as illustrated in Chafin et al by the simple replacement of the part 40 in Chafin et al with the part 40' illustrated in FIG. 11.

Figure 12:
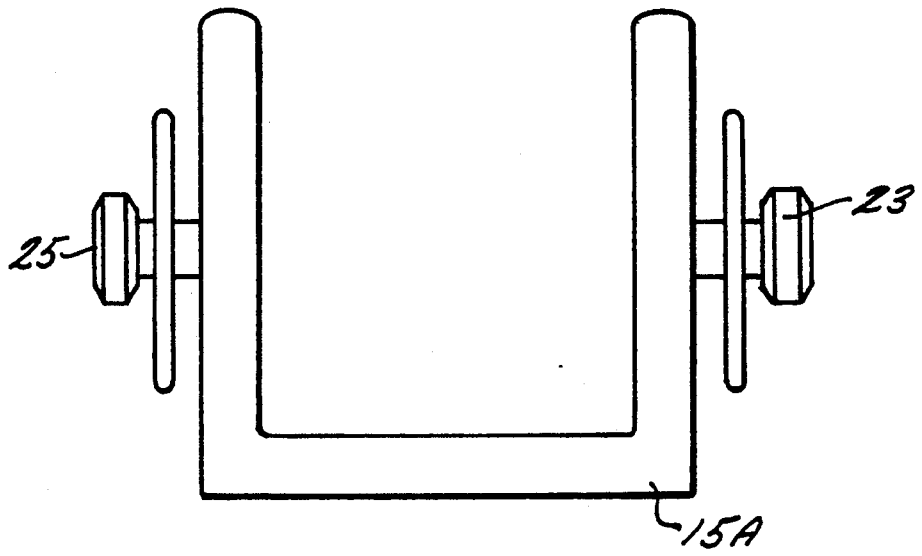
FIG. 12 illustrates an alternative embodiment of a support means which can be used in the embodiments illustrated in FIGS. 1, 2, 6, 6A, 7 and 8.

Although the support means 15 in FIG. 1 (as well as in FIGS. 6 and 8) have been illustrated as circular, the support means can also be U-shaped as illustrated at 15A in FIG. 12.

Figure 13:
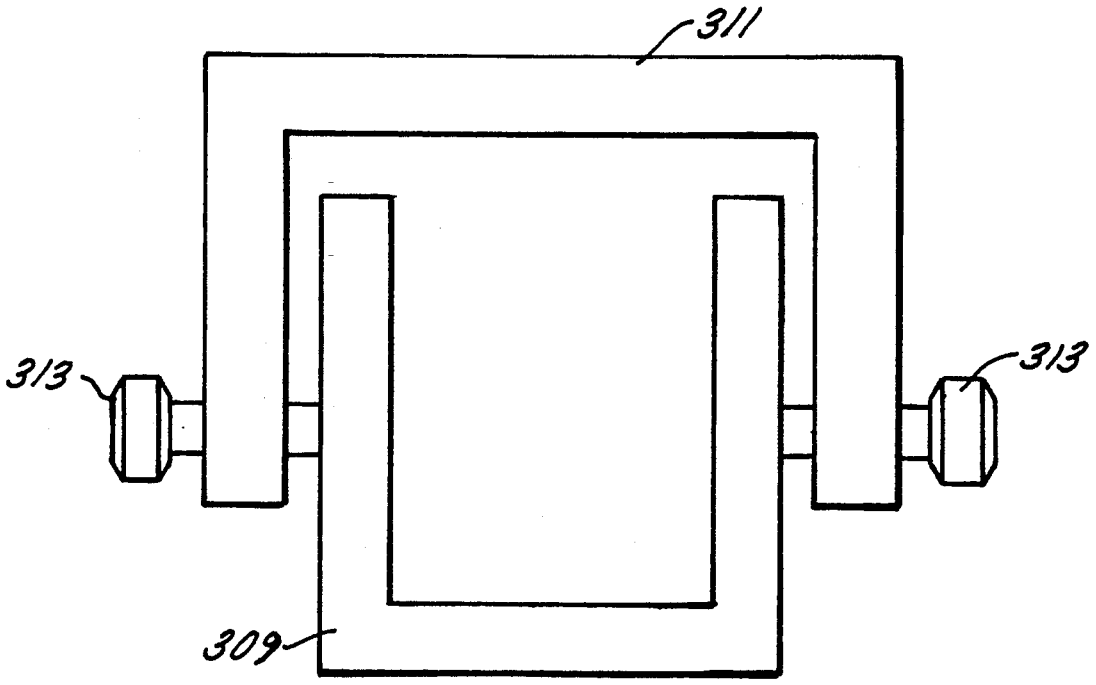
FIG. 13 illustrates an embodiment of the support means which can be used in the embodiment illustrated in FIG. 10.

The support means 309 of FIG. 10 can be U-shaped as illustrated in FIG. 13. The support means 309 is mounted in a holder 311 (see FIGS. 10 and 13) and pivotally supported in the holder 311 by pins or screws 313.

Although a piston and cylinder or a ratchet arrangement have been described as the means for moving the grasping means, it will be clear to one skilled in the art that the piston and cylinder or the ratchet arrangement could be replaced by a motor, preferably an electric motor, and it is within the scope of the present invention to carry out the invention using such a motor.

Although particular embodiments have been described, this was for the purpose of illustrating, but not limiting, the invention. Various modifications, which will come readily to the mind of one skilled in the art, are within the scope of the invention as defined in the appended claims.

I claim:

1. A portable apparatus for removing the pin from the heel of a lady's shoe, comprising:

grasping means for grasping said pin;

moving means for moving such grasping means along a vertical axis in a smooth motion;

a freely pivotable member including a U-shaped portion for supporting said shoe such that, after the shoe is placed in the support and said pin has been grasped, the application of a force to the pin will cause the support to pivot in response to said force such that the pin and heel are automatically aligned along said vertical axis of said applied force so as to maximize the efficiency of the force being applied to said pin;

whereby, when said grasping means grasps said pin, and said shoe is supported in said support means, and said arrangement moves said grasping means in a direction away from said shoe along said vertical axis, said pin is removed from said shoe with a smooth motion.

2. An apparatus as defined in claim 1 wherein said grasping means comprises a pair of spaced jaws defining a gap between them;

rotary handle means for driving said jaws together or apart to close or open said gap.

3. An apparatus as defined in claim 1 wherein said moving means comprises a cylinder and piston arrangement;

said grasping means being disposed at the top of said moving means.

4. An apparatus as defined in claim 3 wherein said grasping means is disposed on the top surface of said piston;

said grasping means underlying said support means;

whereby said grasping means is pulled downwardly to remove said pin from said heel of said lady's shoe;

a spring being disposed in said piston and in said cylinder and extending along the length of said cylinder;

whereby, said piston can be returned to its uppermost position with the aid of said spring.

5. An apparatus as defined in claim 3 wherein said free end of said piston is connected to said grasping means by an L-shaped member, the free end of the vertical leg of the L-shaped member being connected to the free end of the piston, the grasping means being suspended from the free end of the horizontal leg of the L-shaped member;

said support means for supporting said shoe supports said shoe such that said heel extends upwardly along said vertical axis.

6. An apparatus as defined in claim 5 and including a spring disposed in said cylinder and extending along the length of said cylinder and said piston and abutting the upper surface of said piston.

7. An apparatus as defined in claim 1 wherein said moving means comprises a ratchet arrangement;

said grasping means being disposed at the top of said moving means.

8. Apparatus as defined in claim 1 and including means for adjusting the distance between said grasping means and said support means.

* * * * *